US009211630B2

(12) United States Patent
Chang et al.

(10) Patent No.: US 9,211,630 B2
(45) Date of Patent: Dec. 15, 2015

(54) GRINDING MACHINE CONTROL METHOD AND CONTROL SYSTEM EMPLOYING THE METHOD

(75) Inventors: Che-Hua Chang, Chang Hua (TW); Cheng-Chia Wu, Chang Hua (TW)

(73) Assignee: FALCON MACHINE TOOLS CO., LTD., Chang Hua (TW)

( * ) Notice: Subject to any disclaimer, the term of this patent is extended or adjusted under 35 U.S.C. 154(b) by 754 days.

(21) Appl. No.: 13/457,182

(22) Filed: Apr. 26, 2012

(65) Prior Publication Data

US 2013/0237127 A1 Sep. 12, 2013

(30) Foreign Application Priority Data

Mar. 12, 2012 (TW) ..... 101108334 A

(51) Int. Cl.
*B24B 51/00* (2006.01)
*B24B 37/005* (2012.01)
*B24B 37/04* (2012.01)

(52) U.S. Cl.
CPC ..... *B24B 51/00* (2013.01); *B24B 37/005* (2013.01); *B24B 37/04* (2013.01)

(58) Field of Classification Search
CPC ..... B24B 37/005; B24B 37/04; B24B 51/00
USPC ..... 451/5; 700/121
See application file for complete search history.

(56) References Cited

U.S. PATENT DOCUMENTS

| | | | | |
|---|---|---|---|---|
| 5,555,177 | A * | 9/1996 | Simmons | 700/121 |
| 5,664,987 | A * | 9/1997 | Renteln | 451/21 |
| 5,827,110 | A * | 10/1998 | Yajima et al. | 451/5 |
| 6,890,241 | B2 * | 5/2005 | Kozakai et al. | 451/5 |
| 2003/0036342 | A1 * | 2/2003 | Yamada et al. | 451/66 |
| 2004/0248329 | A1 * | 12/2004 | Satake et al. | 438/16 |
| 2009/0326703 | A1 * | 12/2009 | Presley et al. | 700/112 |

* cited by examiner

*Primary Examiner* — Lee D Wilson
*Assistant Examiner* — Tyrone V Hall, Jr.
(74) *Attorney, Agent, or Firm* — Muncy, Geissler, Olds & Lowe, P.C.

(57) ABSTRACT

A grinding machine control method and a control system employing the method is disclosed. The grinding machine control method includes the step of providing a plurality of sub processing procedures each dominating a grinding machine to execute a respective processing step, the step of providing a processing scheduling processing to link the sub processing procedures into a main processing procedure, and the step of executing the main processing procedure to enable the grinding machine to run subject to the processing steps executed by the respective sub processing procedures.

4 Claims, 3 Drawing Sheets

GRINDING MACHINE CONTROL METHOD AND CONTROL SYSTEM EMPLOYING THE METHOD

BACKGROUND OF THE INVENTION

1. Field of the Invention

The present invention relates to grinding technology and more particularly, to a grinding machine control method and a control system employing the method.

2. Description of the Related Art

Grinding processing is a method of using high speed sand grinding wheels to grind the workpiece. This method is practical for processing high hardness materials, and can obtain better processing quality, such as dimension precision and flatness. Further, CNC (computer numerical control) technology has been intensively applied to grinding machines for different grinding purposes.

When operating a CNC grinding machine, it is normally to write up computer numerical control programs for different processing procedures at first, and then to load these computer numerical control programs into a controller in the CNC grinding machine. After simulation of every computer numerical control program subject to a particular processing procedure, the computer numerical control programs are respectively executed to complete the desired grinding processing.

However, when operating the grinding machine subject to the aforesaid method, the operator must separately execute every computer numerical control program subject to the processing procedure. Thus, the grinding processing process is fragmentary and incoherent. If it is necessary to repeat the same processing procedure, the operator must execute the aforesaid processing process again and again, wasting much processing time.

SUMMARY OF THE INVENTION

The present invention has been accomplished under the circumstances in view. It is the main object of the present invention to provide a grinding machine control method and a control system employing the method, which enables different processing procedures to be integrated and executed, enhancing operational convenience and processing efficiency.

To achieve this and other objects of the present invention, a grinding machine control method comprises the step of providing a plurality of sub processing procedures each dominating a grinding machine to execute a respective processing step, the step of providing a processing scheduling processing to link the sub processing procedures into a main processing procedure, and the step of executing the main processing procedure to enable the grinding machine to run subject to the processing steps executed by the respective sub processing procedures.

The grinding machine control method further comprises the step of using a tool management procedure to calculate and recognize the dimensions of the sand grinding wheel of the grinding machine, enabling every sub processing module to execute a next processing step subject to the dimensions of the sand grinding wheel been processed by a preceding sub processing module.

To achieve this and other objects of the present invention, a control system comprises an operating interface module for operation by a user to control the grinding machine, a plurality of sub processing modules for executing one respective sub processing procedure to dominate the grinding machine to run a processing step by means of a controller, and a processing scheduling module for executing a processing scheduling procedure to link each sub processing procedure into a main processing procedure so that a user can operate the operating interface module to execute the main processing procedure in driving the grinding machine to run subject to the processing steps of the sub processing procedures. Thus, all different processing procedures can be integrated and executed, enhancing operational convenience and processing efficiency.

Other advantages and features of the present invention will be fully understood by reference to the following specification in conjunction with the accompanying drawings, in which like reference signs denote like components of structure.

DETAILED DESCRIPTION OF THE INVENTION

Figure 1:
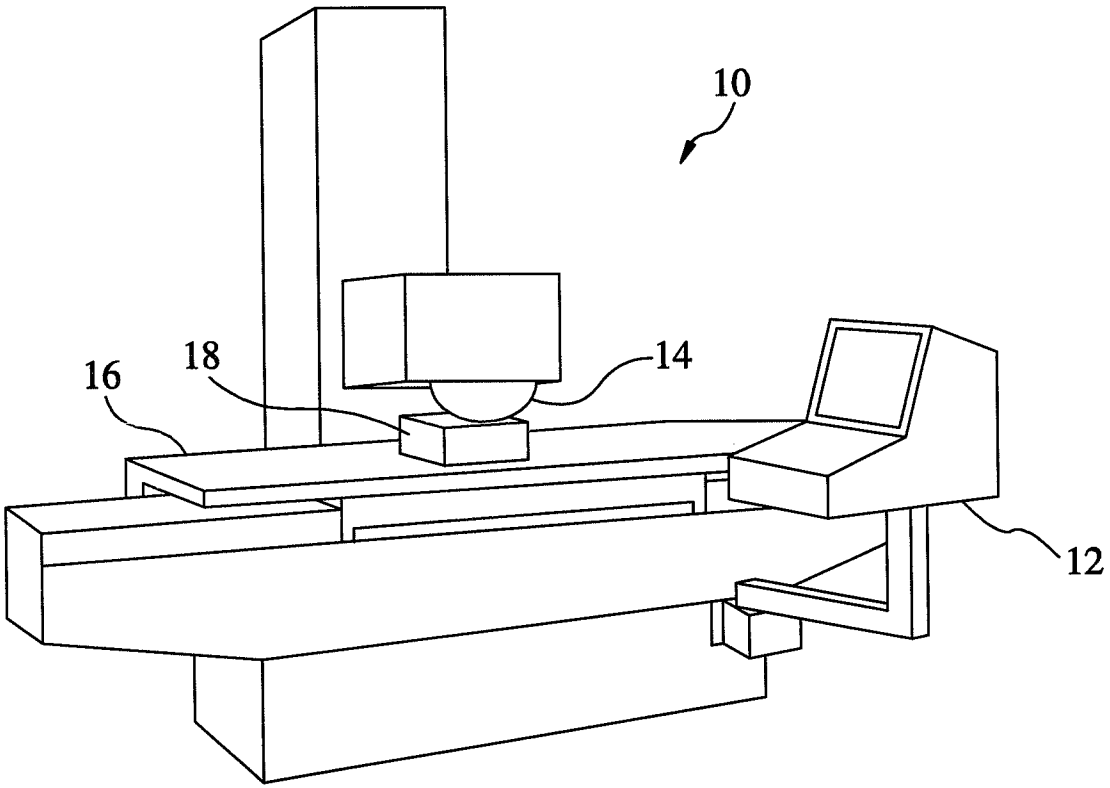
FIG. 1 is a schematic drawing of a grinding machine provided by the present invention.
Figure 2:
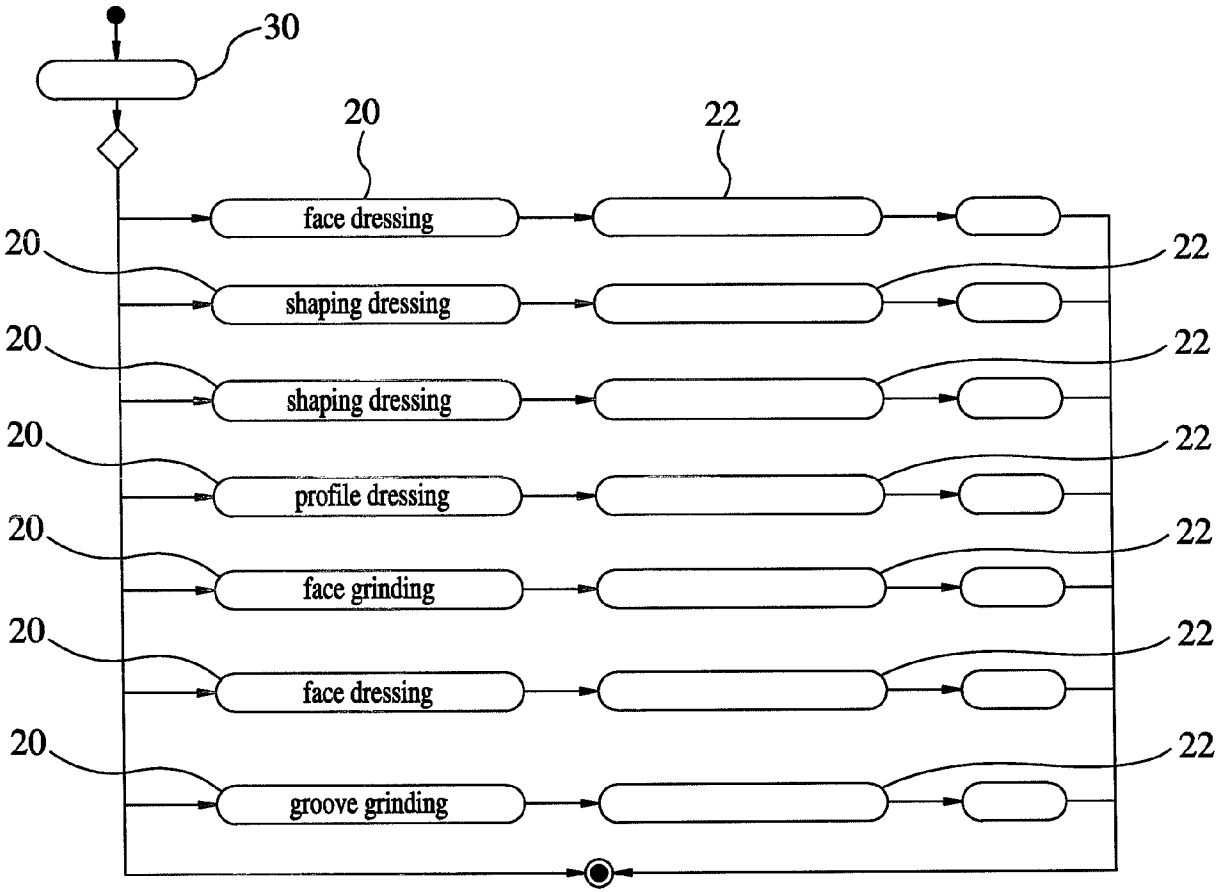
FIG. 2 is an operation flow chart of the present invention.
Figure 3:
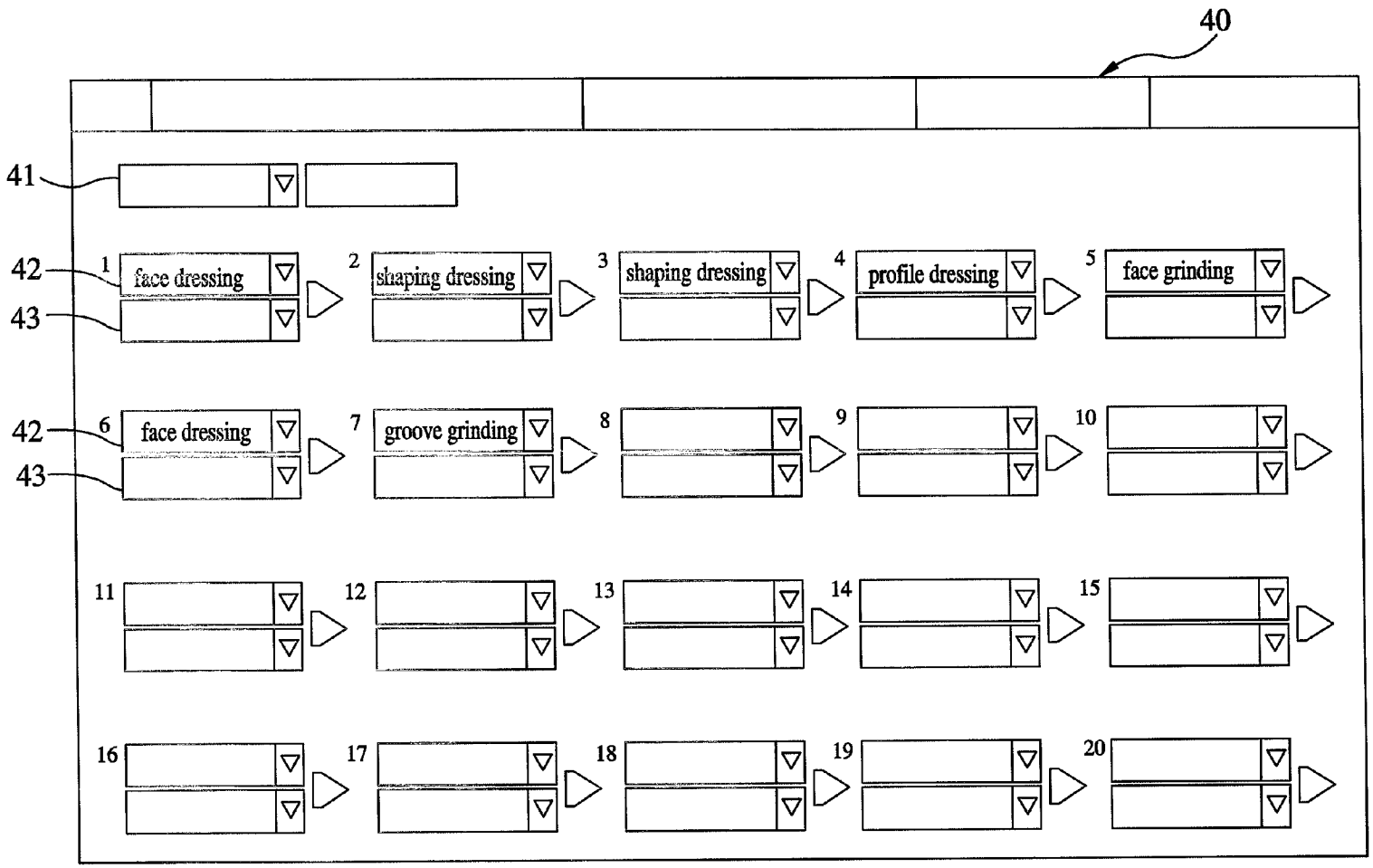
FIG. 3 is a schematic drawing illustrating the operating interface module of the grinding machine constructed according to the present invention.

Referring to FIGS. 1-3, the present invention provides a grinding machine control method and a control system employing the method. The control system is used in a grinding machine 10. The grinding machine 10 comprises a worktable 16, a programmable controller 12, and a sand grinding wheel 14 controllable by the programmable controller 12 to rotate at a high speed and to grind a workpiece 18 on the worktable 16.

The grinding machine control method includes the steps of:

1. Set a plurality of sub processing modules 20 in the programmable controller 12 to respectively execute one respective sub processing procedure 22 in controlling the grinding machine 10 to execute a respective processing step, wherein each sub processing procedure comprises a series of G-codes for executing different processing, such as sand grinding wheel face dressing, shaping roller dressing, wheel-head shaping dressing, sand grinding wheel profile dressing, face grinding, groove grinding or profile grinding; the sub processing modules 20 can have different processing parameters for one same processing step.

2. Set a processing scheduling module 30 in the programmable controller 12 for executing a processing scheduling procedure to link the sub processing procedures 22 of the sub processing modules 20 into a main processing procedure that has the sub processing procedures 22, such as face grinding, groove grinding, profile grinding, face dressing, shaping dressing, wheel-head dressing and profile dressing, be linked into a series of processing steps.

3. Execute the main processing procedure, driving the grinding machine 10 to run all the sub processing procedures 22 of the sub processing modules 20 at a time.

During the execution of the main processing procedure, the programmable controller 12 synchronously calculate and recognize the dimensions of the sand grinding wheel 14 through a tool management procedure, enabling every sub processing module 20 to execute a next processing step subject to the dimensions of the sand grinding wheel 14 processed by a preceding sub processing module 20.

Referring to FIG. 3 again, the grinding machine 10 further comprises an operating interface module 40 controllable by the programmable controller 12. The operating interface module 40 comprises at least one main column 41, a plurality of first sub columns 42 and a plurality of second sub columns 43. The first sub columns 42 are adapted for enabling the operator to set one sub processing module 20 to be executed by means of the operating interface module 40. The second sub columns 43 respectively correspond to the first sub columns 42. By means of the second sub columns 43, the operator can further set a respective sub processing module 20 of the same type of processing step with a different processing parameter. The operator sets the first sub columns 42 and the second sub columns 43 respectively subject to the respective processing procedures, and then sets each finished main column 41 to be a respective main processing procedure, and then operates the operating interface module 40 to run each established main processing procedure, driving the grinding machine 10 to operate subject to the processing procedures 22 of the sub processing modules 20.

By means of the aforesaid grinding machine control method, the operator simply needs to execute one main processing procedure for enabling all various processing steps to be performed in proper order without paying extra attention to the processing steps and process all the time. Thus, this grinding machine control method greatly reduces the processing operation time. Further, after completion of the setting of one main processing procedure, it can be repeatedly used in the follow-up grinding processing, enhancing the processing efficiency and reducing the cost. Further, using the operating interface module 40 can alter and adjust the processing steps subject to different processing procedures, enhancing operational convenience and applicability.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A grinding machine control method, comprising the steps of:

providing a plurality of sub processing procedures, each said sub processing procedure dominating a grinding machine having a sand grinding wheel to execute a respective processing step;

providing a tool management procedure to calculate and recognize the dimensions of said sand grinding wheel of said grinding machine;

providing a processing scheduling processing to link said sub processing procedures into a main processing procedure; and executing said main processing procedure to enable said grinding machine to run subject to the processing steps executed by the respective sub processing procedures, enabling every said sub processing procedure to execute a next processing step subject to the dimensions of said sand grinding wheel been processed by a preceeding sub processing procedure.

2. The grinding machine control method as claimed in claim 1, further comprising displaying each said sub processing procedure and each said main processing procedure in an operating interface module.

3. The grinding machine control method as claimed in claim 2, further comprising operating said operating interface module to change the order of the sub processing procedures of each said main processing procedure.

4. The grinding machine control method as claimed in claim 1, wherein each said processing step is one of the processing steps of face grinding, groove grinding, profile grinding, face dressing, shaping dressing, wheel-head dressing and profile dressing.

* * * * *